US007255248B2

(12) United States Patent
Cater

(10) Patent No.: US 7,255,248 B2
(45) Date of Patent: Aug. 14, 2007

(54) PLUG STYLE PUMP

(75) Inventor: Miro S. Cater, Daytona Beach, FL (US)

(73) Assignee: Emsar, Inc., Stratford, CT (US)

( * ) Notice: Subject to any disclaimer, the term of this patent is extended or adjusted under 35 U.S.C. 154(b) by 304 days.

(21) Appl. No.: 10/648,387

(22) Filed: Aug. 27, 2003

(65) Prior Publication Data

US 2004/0173639 A1 Sep. 9, 2004

Related U.S. Application Data

(60) Provisional application No. 60/406,636, filed on Aug. 29, 2002.

(51) Int. Cl.
*B65D 88/54* (2006.01)

(52) U.S. Cl. ..... 222/321.7; 222/321.9

(58) Field of Classification Search ..... 222/321.7, 222/321.9, 383.1, 385, 321.2, 341, 321.8
See application file for complete search history.

(56) References Cited

U.S. PATENT DOCUMENTS 3,724,726 A * 4/1973 Susuki et al. ..... 222/321.9
4,252,507 A * 2/1981 Knickerbocker ..... 417/444
4,524,888 A * 6/1985 Tada ..... 222/153.02
4,762,475 A * 8/1988 Fuchs ..... 417/550
4,930,999 A * 6/1990 Brunet et al. ..... 417/552
4,944,432 A * 7/1990 Jouillat ..... 222/321.2
5,105,994 A * 4/1992 Jouillat et al. ..... 222/341
5,271,532 A * 12/1993 Jumel et al. ..... 222/321.9
5,363,993 A 11/1994 Mascitelli et al.
5,566,865 A * 10/1996 Jouillat et al. ..... 222/287
5,642,908 A 7/1997 Mascitelli
5,709,324 A 1/1998 Peronnet et al.
6,279,786 B1 8/2001 de Pous et al.
6,371,337 B2 * 4/2002 Garcia et al. ..... 222/385
6,446,841 B1 * 9/2002 Petit ..... 222/321.9
6,527,149 B1 * 3/2003 Garcia et al. ..... 222/321.9
6,634,872 B1 * 10/2003 Bougamont et al. ..... 417/549

* cited by examiner

*Primary Examiner*—Frederick C. Nicolas
(74) *Attorney, Agent, or Firm*—Kenyon & Kenyon LLP

(57) ABSTRACT

The embodiment of the invention are directed to a dispenser assembly having a reservoir bottle with an opening for fluid communication. The opening is formed to receive a housing cap and a dispensing pump such that the dispensing pump is sealingly engaged to the bottle opening. The housing cap has an outer surface in contact with the reservoir opening and an inner surface in contact with the dispensing pump. The outer surface includes a lip which engages the reservoir opening and a step which engages the pump.

18 Claims, 8 Drawing Sheets

PLUG STYLE PUMP

This Application claims priority to U.S. Provisional Application No. 60/406,636 filed Aug. 29, 2002, and incorporates said Provisional Application in its entirety.

BACKGROUND OF THE INVENTION

The present invention relates to dispensing in general and more particularly to an improved bottle and pump and the combination thereof which can be used to dispense liquids, for example, as an atomized spray or a similar dispensing device for non pressurized packages.

Conventionally, small pumps are mounted on glass bottles by means of what is known as a ferrule or mounting cup. An example of such a pump is that described in U.S. Pat. No. 5,277,559, assigned to the assignee of the present invention. As shown in FIG. 1 thereof, the upper portion of the pump body is crimped into the mounting cup 6. The mounting cup 6 may then crimped onto the bottle which contains a lip at the end of a neck. This requires a gasket 7 and the aluminum ferrule 6.

There have been attempts to mount a pump directly to a bottle in a manner which eliminates the gasket and aluminum ferrule. However, any such attachment method must solve two problems: it has to provide means of sealing (formerly done by the gasket) and means of retention (formerly done by the ferrule). These have not been easy to solve without increased expense. The glass internal dimensions, i.e., inside the neck, vary greatly because of the unpredictable distribution of glass during blow molding operation. Thus, attempts that have been made require very expensive glass manufactured with much closer tolerances than those obtained in a conventional blow molding process.

Thus, there is a need for a bottle and a pump with which it is possible to simply be able to press a pump into the neck of a blow molded bottle in a reliable manner with good retention and sealing. Such will not only reduce cost but also open new package design opportunities.

SUMMARY OF THE INVENTION

In accordance with embodiments of the present invention, a pump has a pump body with an inner end and an open outer end. The pump body forms a cylinder and a piston is disposed for reciprocal movement in the cylinder. A spring biases the piston toward the open outer end and an inlet valve is disposed at the inner end of the cylinder.

The pump also includes a stem having a central bore for dispensing a fluid from the cylinder with an outlet valve coupling the cylinder to the bore of the stem. An actuator is disposed on the stem in fluid communication therewith. A plug is inserted and retained in and projects from the outer open end of the pump body, the plug restraining outward movement of the piston.

Embodiments of the present invention also include a bottle which has a body, with a neck atop the body forming an inlet passage terminating in an opening. Thin walls are formed around the opening and a relatively thick section is spaced some distance below the opening forming an undercut.

The pump may be press-fitted into the bottle with the pump housing inserted in and engaging the inside of the neck below the undercut and with the projecting portion of the plug engaging outer portion of the inside of the neck.

DETAILED DESCRIPTION

Figure 2:
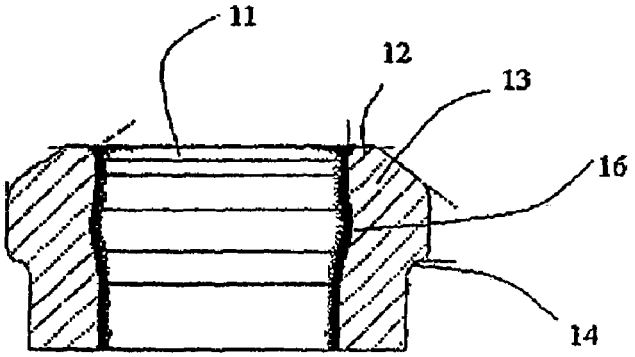
FIG. 2 is a crossectional view of a blow molded bottle according to the present invention.

The purpose of the present invention is to attach a pump (or similar dispensing device for non pressurized packages) directly into a glass bottle opening. In order to do so and avoid the costly precision molded bottles previously required, in accordance with embodiments of the present invention, it was first necessary to develop a new glass finish that yields a more accurate sealing surface at no additional manufacturing cost. The shape of a suitable neck is shown in FIG. 2. Thin walls 12 around the opening 11 of the bottle 10 promote rapid glass cooling for higher accuracy of sealing diameter. A thick section 13 at the transfer bead results in a 'sink' or undercut 16 for pump retention. In addition, although designed for use with a pump which can be pushed in, the new finish allows for conventional crimp attachment. In one embodiment this might be a 15 mm crimp attachment. Thus, to accommodate use with pumps mounted with ferrules, a crimp surface 14 is provided.

The relatively thin section 12 immediately at the opening is used for pump sealing. When the glass is kept relatively thin it that area, it cools rapidly in the metal bottle mold, thus maintaining its shape and size relatively accurately. The thick section of the glass remains hot during the blow molding operation, and will produce the 'sink' or undercut 16 on the inside diameter as shown in FIG. 2. As noted this area is used for pump retention. The shape of the glass is such that it yields an internal finish suitable for mounting a pump by pressing in, without a change in a manufacturing process. The glass can therefore be produced at about the same cost as the cost of conventional bottles.

Figure 3:
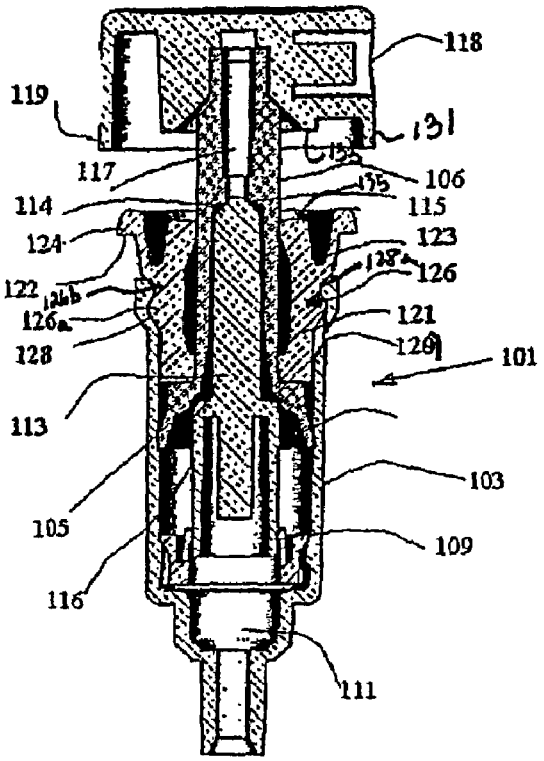
FIG. 3 is a cross-sectional view of a conventional pre-pressure pump modified in accordance with a first embodiment of the present invention for insertion into the bottle of FIG. 1.

FIG. 3 shows a pump 101 according to the present invention. This pump is based on a conventional pre-pressure pump of the type shown in U.S. Pat. No. 5,277,559. However, the present invention is applicable any type of manually operated pump or dispensing device. The pump includes a cylinder 103, in which a piston 105 on the end of a pump stem 106 slides. Piston 105 includes an outlet passage 117 which leads to the atomizing nozzle 118. Atomizing nozzle 118 is housed on an actuator assembly 119. Mounting of the pump 101 on a bottle (not shown) will be described in detail below.

Contained within the cylinder 103 is a valve stem 113. Valve stem 113 includes an upper end 114 which seats against a valve seat surface 115 on the piston 105, and a lower portion 116. A spring (not shown) biases the stem 113 axially-outward into engagement with the valve seat 115. The valve stem 113 is constructed such that there is an axially-outward facing net surface area within the pump chamber after the inlet valve is closed, thereby allowing the outlet valve 114,115 to open only when sufficient pressure is generated within the pump chamber. This "precompression" operation is shown and described in the pumps of U.S. Pat. Nos. 4,144,987 and 4,389,003.

An inlet seal valve 109 is mounted near the bottom of the pump chamber 107. During inward motion of the piston 105, the valve 109 seals the inlet 111 to the pump chamber. In conventional fashion, as pressure builds up in the pump chamber 107 valve member 113 moves to the inwardly away from a seat to 115. This allows material to be dispensed through the outlet 117 to atomizer 118. Operation of the pump is conventional and described in the afore-mentioned U.S. Pat. No. 5,277,559. As described in that patent, the pump was mounted to a container with a mounting cup which had to be crimped on the pump and container and also included a sealing device at the outer end of the pump. In some instances this is referred to as a "housing cap."

Figure 1:
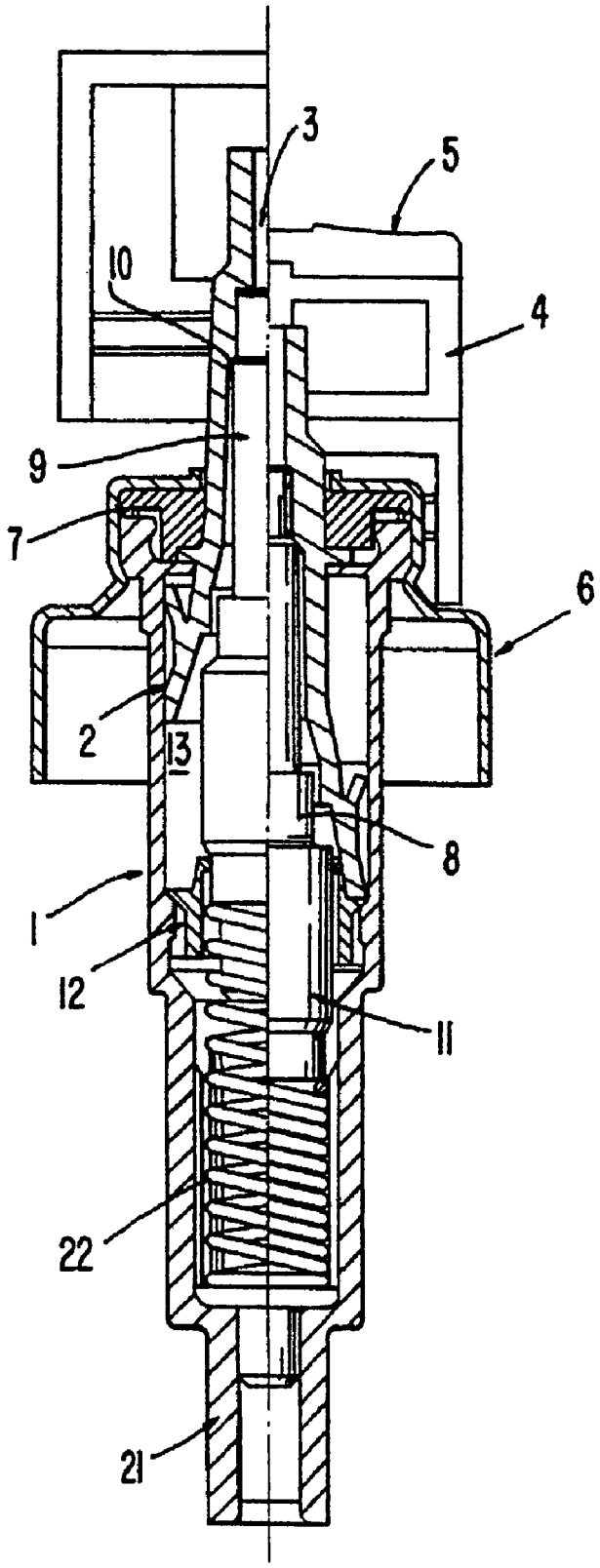
FIG. 1 is a crossectional view of a prior art pump crimped into a mounting cup.

In accordance with the present invention, the pump was re-shaped to incorporate a different "housing cap" 121 as shown FIG. 3. This element may also be referred to as a plug. The pump illustrated is a modification of a pump sold by Emsar under the designation 31 MS. However, the concept of the present invention is applicable to other pumps or dispensers that employ some sort of a housing with a top closure. The polyethylene housing cap 121 has an upper (outer) tapered cylindrical area 123 that, in one embodiment, is adapted to engage the first 1 mm of the bottle opening, i.e., the thin section 11 of FIG. 1. This area is used for sealing. The lower part 129 of the housing cap 121 attaches to the pump housing 103. This area has a relatively thick section 126 and is used to reinforce the pump housing 103 as it is pressed into a relatively inaccurate area of the bottle neck. As shown the relatively thick section 126 has a bead-like cross-section and a protrusion 126*a* engages a recess 128 in the inner surface of the pump housing, and a projection 128*a* on the pump housing engages a notch 126*b* on the housing cap 121. The pump housing 103 may, or may not, contact the inner surfaces of the glass, depending on the glass dimensions. The plug terminates at its outer end with an annular flange 124 with a flat inner surface 122.

The pump 101 is installed by pressing on the central area of the housing cap with a tool or with the actuator 119 itself. In accordance with the present invention, the actuator 119 is shaped so that its outer portion 131 will not contact the neck of the bottle before an inner portion 133 is able to contact an upper surface 135 on the cap 121 to push the whole assembly into the neck of the bottle. As the pump assembly is pressed into the neck of the bottle 10 to the position shown in FIG. 4, it will displace air and build of pressure. In order to relieve this pressure, the lower part 129 is formed in the wall of the housing 103 as seen in FIGS. 3 and 4.

Figure 4:
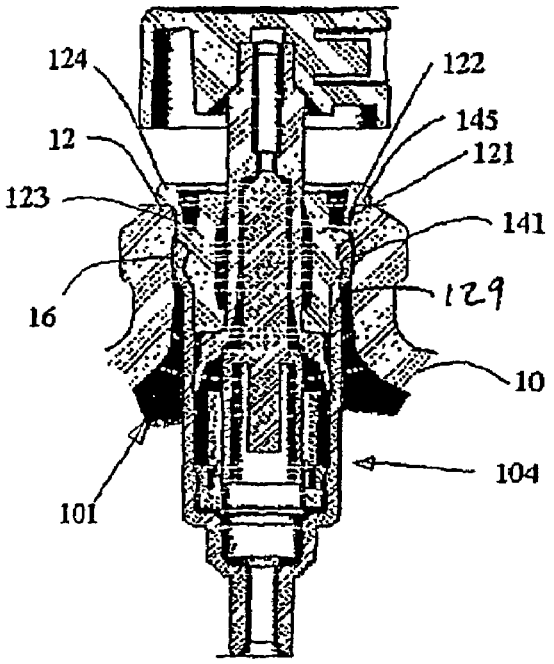
FIG. 4 is a cross-sectional view of the pump and bottle FIG. 3 after the pump has been pressed into place.

FIG. 4 is a cross-sectional view showing the pump 101 mounted into the neck of the bottle. The upper enlarged portion 141 of the pump housing 104 retains the pump in the neck of the bottle as it is pushed in contact with the retention undercut 16 formed in the bottle 10. The tapered part 123 of the plug engages the outer part 12 of the neck to create a seal, with the flat inner surface 122 of the flange 124 abutting against a flat surface 145 on the top of the opening. All of the functional components of the pump are moved below the bottle neck and are unaffected by the varying interference's with the bottle.

The disassembly of the pump housing 104 from the cap 121 is impossible, as long as the gap between the inner glass surface and the housing is smaller than the retention undercut between the pump housing 104 and the cap 121.

It should also been noted that the piston and actuator in this embodiment are revised compared to the conventional pump made and sold by Emsar. In a particularly illustrated embodiment, the pump has a very low profile of '~'0.400" (10 mm).

Figure 5:
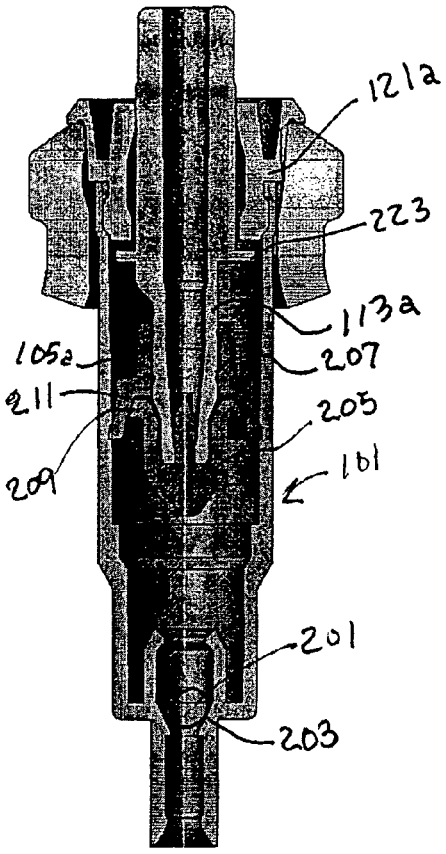
FIGS. 5-9 are cross-sectional views of alternative implementations of the first embodiment of the present invention showing this embodiment with different pumps.

FIGS. 5-10 are cross-sectional views of alternative implementations of the first embodiment of the present invention showing this embodiment with different pumps. In the pump 101*a* of FIG. 5, the inlet valve is a ball-check valve, including a ball 201 that seats on a seat 203. The outlet valve includes a member 205 on the end of stem 113*a* which extends through opening 207 in piston 105*a*. Member 205 has a sealing surface 209 that seals against an inner surface 211 of piston 105*a*. Normally, a spring (not shown) biases the member 205 into sealing engagement with the surface 211. Actuation of pump causes the ball 201 to seat on seat 203 and member 205 to move inwardly from piston 105*a* to permit discharge of the fluid in the pump chamber 107*a*. Housing cap 121*a* in FIG. 5 is generally like housing cap 121 of FIG. 4. However, its downward extent is a bit less and its bottom surface is adapter to engage a flange 223 of stem 113*a* to limit upward movement of stem 113*a*.

Figure 6:
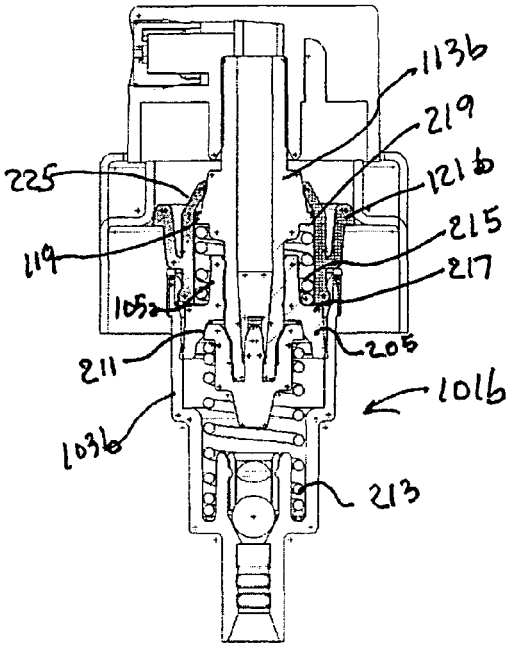

The pump 101*b* of FIG. 6 operates in similar fashion. The spring 213 biasing the member 205 against surface 211 is shown in this embodiment. Also included is a second spring 215 between an upper surface 217 of piston 105*a* and a flange 219 on stem 113*b*. The housing cap 121*b* of FIG. 6 is modified to work with the pump 101*b* of FIG. 6. This pump has a shorter cylinder 103*b*. The primary difference in housing cap is the shaping of its upper end 225 to be frustroconical so as to form a surface to retain stem 113*b*. The upper surface of flange 119 is biased into engagement with upper end 225, which acts to limit its outward movement.

Figure 7:
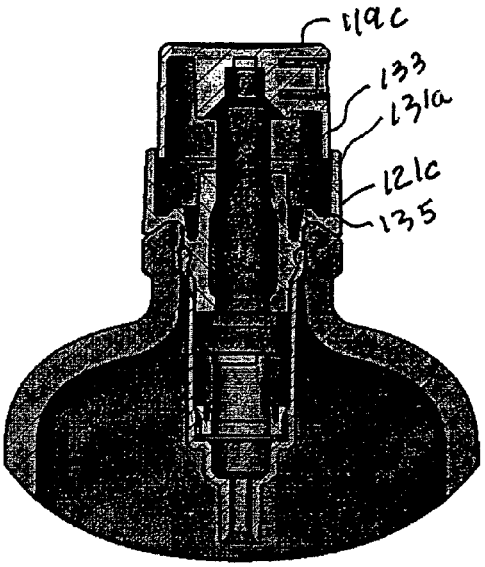
Figure 8:
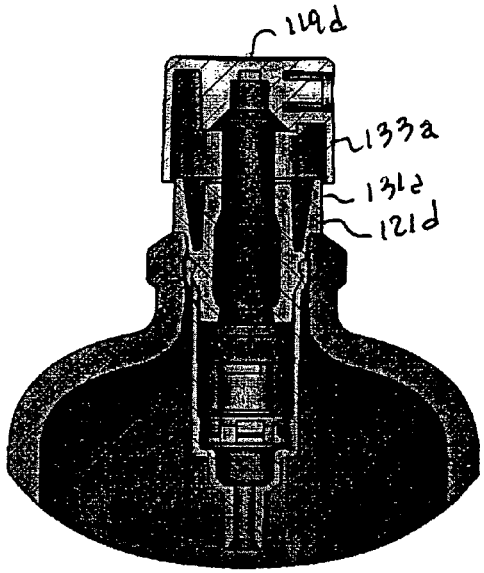
Figure 9:
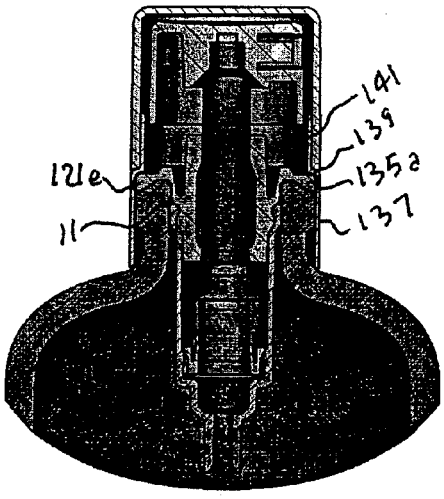

FIGS. 7-9 show additional variations. FIG. 7 shows a housing cap 121*c* with an outwardly extending cylindrical member 131,. into which a downwardly extending cylindrical part 133 of actuator 119*c* telescopes and is guided. Because of this housing cap 121*c* has an extension 135 extending radially outwardly, and shaped to mate with the top of bottle 10, on the end of which is the axially outwardly extending member 131*a*. FIG. 8 is similar except that the inwardly extending cylindrical part 133*a* of actuator 119*d* slides over an outwardly extending cylindrical member 131*a* formed on the housing cap 121*d*.

In FIG. 9, a similar extension 135*a* is present. Here, a separate metal sleeve, with an inner cylindrical part 137, a stepped part 139 and an outer cylindrical member 141 is provided. The inner cylindrical part is press fit over the outer part of the opening 11 of bottle 10 with the stepped portion 139 engaging the top of housing cap 121*e*.

Figure 10:
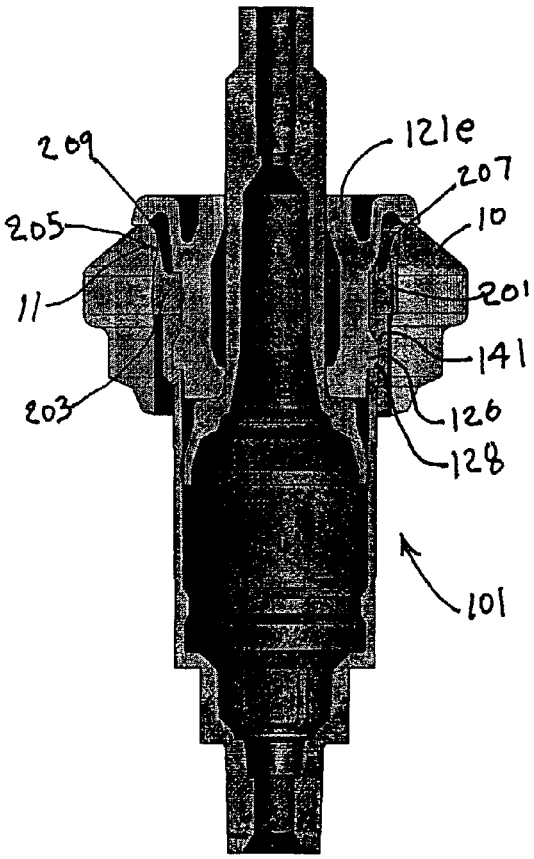
FIG. 10 is a cross-sectional view of a second embodiment that includes a seal showing the pump and bottle after the pump has been pressed into place.

FIG. 10 is a cross-sectional view of a second embodiment of the present invention in which a pump 101 has been pressed into place in the bottle 10. This embodiment includes the same kind of pump as shown in FIG. 2-4 and that pump will not be again described. The main difference in this embodiment is the inclusion of a seal 201. The seal 201 includes an annular inner part 203 of rectangular cross section from which a sealing lip 205 extends axially outwardly. The sealing lip also extends at a small angle causing it to also extend radially outward a small amount.

Seal 201 is disposed atop the enlarged outer portion 141 of pump 101. The outer diameter of annular part 203 is slightly larger than that of portion 141. Housing cap 121*e* includes a projection 126 which engages a recess 128 in the inner surface of the pump housing. A flange portion 207 extending radially outwardly is formed in housing cap 121*e* and engages the outer surface 209 of annular part 203, holding it in contact with the portion 141. In this case the seal 201, particularly the sealing lip 205 seals against the inner surface 11 of the bottle 10.

Figure 11:
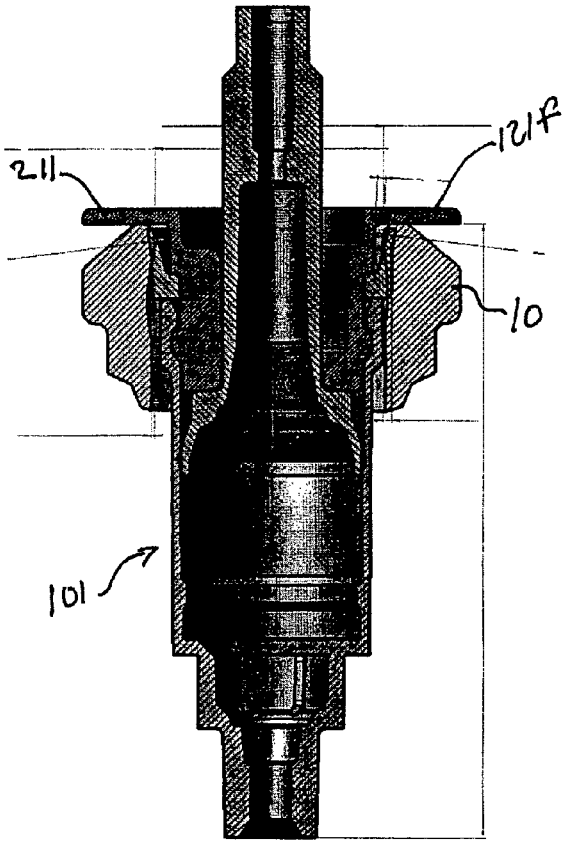
FIG. 11 is a cross-sectional view of an alternative implementation of the second embodiment with a first type of pump and bottle after the pump has been pressed into place.

FIG. 11 is a cross-sectional view of an alternative implementation of the second embodiment, after the pump 101 has been pressed into place in bottle 10. This differs only in the details of the housing cap 12 If, which is molded in a side action mold to produce a sharp undercut for better housing retention. The top of the housing cap differs from that of FIG. 10 in that it is a flat radially outwardly extending flange 211.

Figure 12:
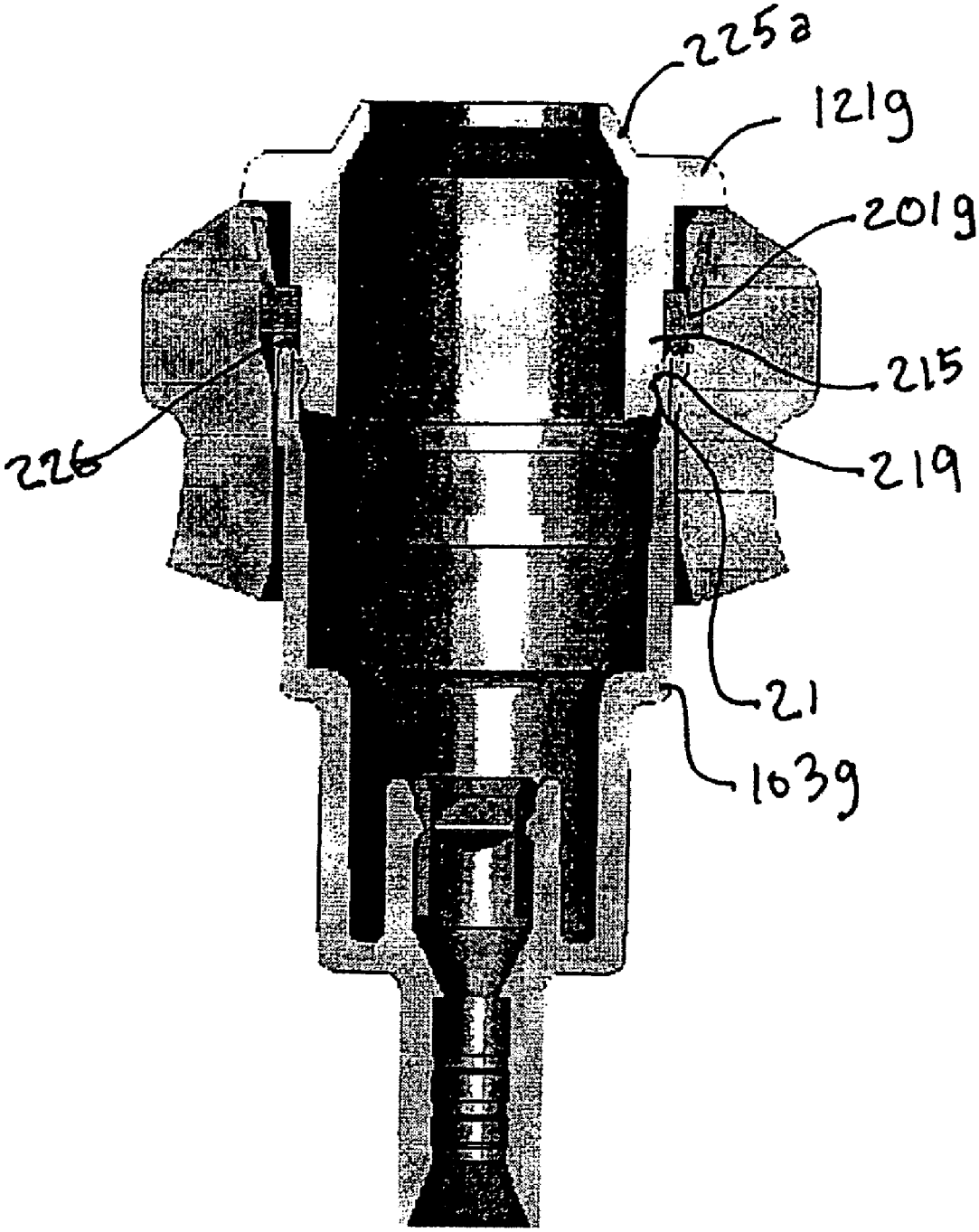
FIG. 12 is a cross-sectional view of the second embodiment with a second type of pump.

FIG. 12 is a cross-sectional view of the second embodiment with a second type of pump (not shown). This is a pump similar to that shown in FIG. 6, and will not be again described. In this case the lower cylindrical part 215 of housing cap 121*g* has a recess 217 that is engaged by an inwardly projecting bead 219 at the axially outer end of cylinder 103*g*. Note that, as in FIG. 6, the axial outer end 225*a* of housing cap 121*g* is frustroconical to retain the pump. This embodiment also includes a gasket 226 between the seal 201*g* and the top of the cylinder 103*g*.

The advantage of the embodiment of FIGS. 10-12 over that of FIGS. 2-4 include a wider bottle ID tolerance +/−0.25 mm., improved retentions of the housing cap in the pump body and the pump in the bottle, and improved sealing characteristics.

Figure 13:
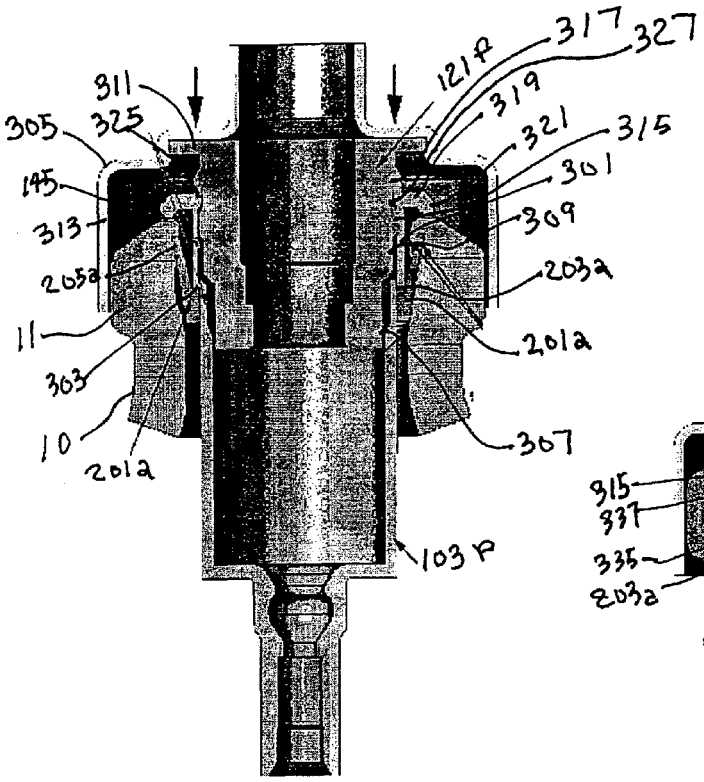
FIG. 13 is a cross-sectional view of a third embodiment of a pump and bottle before the pump has been pressed into place.
Figure 14:
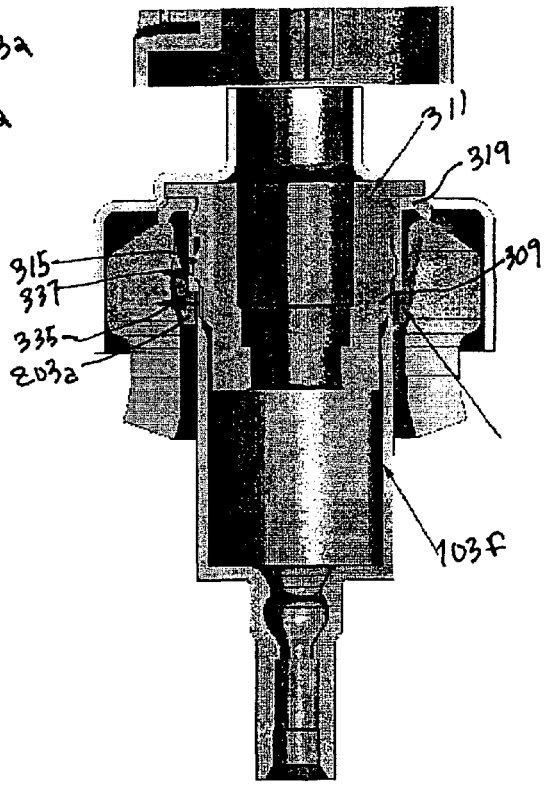
FIG. 14 is a cross-sectional view of the third embodiment after the pump has been pressed into place.

FIG. 13 is a cross-sectional view of a third embodiment of a pump and bottle before the pump has been pressed into place and FIG. 14 is a cross-sectional view of the third embodiment after the pump has been pressed into place. In this embodiment, the pump housing has an outer cylindrical portion 301 of greater diameter than the cylinder 103*f*, with a step forming a ledge 303. The housing terminates in a radially outwardly extending flange 319 having an axially inwardly extending annular projection 321 at it radial outer end. The annular projection 321 rests on the flat top 145 of opening 11. A seal 201*a* of the type disclosed in connection with FIGS. 10-12 is disposed between the pump housing and the inner surface of opening 11. The outer surface of annular part 203*a* of seal 201*a* abuts the ledge 303. The sealing lip 205*a* is shown prior to deformation.

Housing cap 121*f* has an inner cylindrical portion 307 of a first diameter which transitions to an outer cylindrical portion 309 of greater diameter, and terminates at its axially outer end in a radially extending flange 311. The flange 311 is retained in a mounting cup 305 that has an inwardly extending hollow cylindrical portion 313 that surrounds the neck 11 of bottle 10. Outer cylindrical portion 309 include an annular projection or bead 315. Above bead 315 is a further projection 317 forming a flat annular surface 325.

In the view of FIG. 13 the housing cap has been pushed into the pump housing until the flat annular surface 325 abuts flange 319. A radially inwardly projecting bead 327 at the outer end of the pump housing is retained between projections 315 and 317. The assembly, along with seal 201*a* are first inserted into opening 11. Then an additional inward axial force is applied to force projection 317 past the bead 327 until flange 311 abuts flange 319. The portion 309 of the housing cap has an outer diameter greater than the inner diameter of the top of cylinder 103*f*. Thus, when pushed in, it exerts a radial outward force on the cylinder 103*f*, pushing it into better engagement with annular part 203*a* of seal 201*a* as shown by arrow 335. Projection 315 similarly acts against housing part 301 as shown by arrow 337.

This embodiment provides good retention and seal. However, it is more complex and requires that the pump housing be flexible, for example made of polypropylene. It also requires a larger pump body outer diameter. It is also difficult to implement in a modular design.

Figure 15:
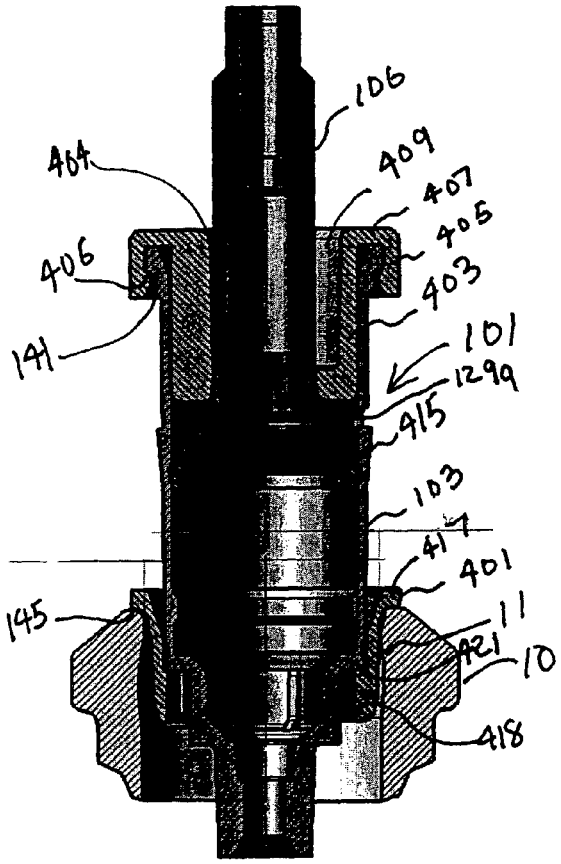
FIG. 15 is a cross-sectional view of a fourth embodiment including a sealing sleeve showing a pump and bottle before the pump has been pressed into place.
Figure 16:
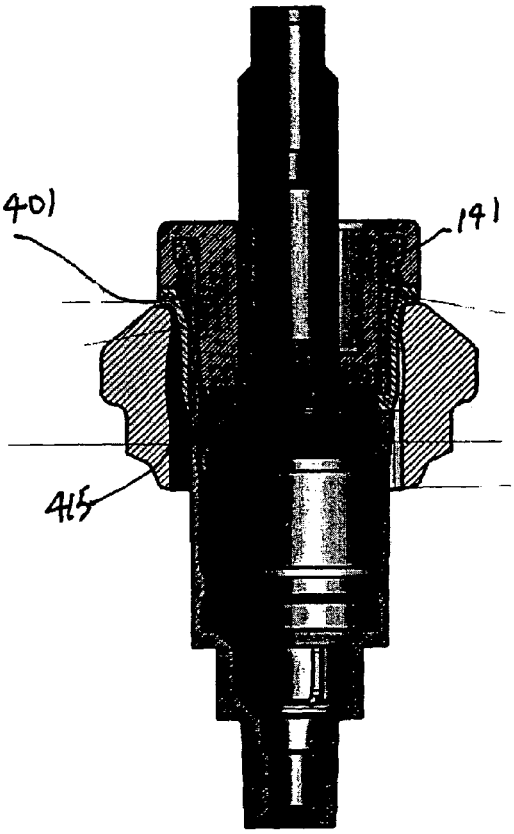
FIG. 16 is a cross-sectional view of the fourth embodiment after the pump has been pressed into place.

FIG. 15 is a cross-sectional view of a fourth embodiment including a sealing sleeve showing a pump 101 and bottle 10 before the pump has been pressed into place. FIG. 16 is a cross-sectional view of the fourth embodiment after the pump 101 has been pressed into place. This embodiment has a flexible seal 401 that is attached to the pump housing in a manner that allows for its expansion after the pump is placed on the bottle. In FIG. 15, the seal 401 in inserted into the opening 11 in bottle 10. Seal 401 has a generally cylindrical body 418 terminating at its outer end with a flange 417. In the view of FIG. 15, this flange is abutting the flat surface 145 of the opening 11 of bottle 10. The lower portion 419 of body 418 has a smaller inner diameter and forms a ledge 421. In FIG. 15, a bottom surface of cylinder 103*g* abuts ledge 421.

The housing cap 121*g* includes an annular body 403 containing a channel 409 therein. The pump stem 106 extends through the central opening 404 in body 403. The outer end of body 403 terminates in a radially outwardly extending portion 407, at the radial outer end of which is a downwardly extending annular portion 405, having an inwardly projecting bead 406 at its inner end. A channel 406 is formed between body 403 and portion 405, into which the enlarged outer end 141 of the pump body is inserted. The bead 406 snaps around the outer end 141 retaining the housing cap in place.

The cylinder 103 is formed with retention undercuts 415, resulting in sections of increased outer diameter undercut at their outer ends. The installation is complete when the pump is forced through the seal 401 to the position shown in FIG. 16 . This expands the seal 401 and provides for good retention to the bottle. The undercuts 415 snap into place below the inner end of the seal 401 to retain the pump in place. The pump housing is molded in a side action mold to form the venting orifice 129*g* and retention undercuts 415.

This embodiment has a number of advantages including the ability for modular design and improved retention of the housing to the housing cap. In this embodiment the seal is made in a softer material, preferably of low density polyethylene. The seal 401 is assembled to the housing in a final assembly operation (not module assembly). Different sizes of seals could, be used to accommodate different neck diameters. The seal stops on the bottle placement on the bottle, when the pump is placed into the neck.

Various embodiments have been disclosed as have variations of the different embodiments. These and other modifications can be made without departing from the spirit of the invention which is intended to be limited solely by the appended claims.

What is claimed is:

1. A housing cap for securing a dispenser pump to a reservoir having an opening comprising:

an annular body having an upper end and a lower end, the upper end having an outwardly extending lip, an outer surface of the lip sealingly engages an inner surface of the opening of the reservoir, the lower end having a protrusion for engaging the pump at a first location;

the annular body defining at least one notch for engaging the pump at a second location.

2. The housing cap of claim 1, wherein the lip is defined by a helical area protruding from the annular body.

3. The housing cap of claim 2, wherein the helical area protruding from the annular body defines a flange.

4. The housing cap of claim 1, wherein the outwardly extending lip further defines an annular flange.

5. The housing cap of claim 4, wherein the flange encloses at least a portion of the reservoir.

6. A housing cap for securing a dispenser pump to a reservoir comprising:

an annular body having an upper end and a lower end, the upper end having an outwardly extending lip, an outer surface of the lip sealingly engages to a portion of the reservoir, the outwardly extending lip having an annular extension shaped to mate with the reservoir and having an outwardly extending member;

the lower end having a protrusion for engaging the pump at a first location;

the annular body defining an annular notch for engaging the pump at a second location and a recess spanning alone an inner surface of the body between the upper and lower ends.

7. The housing cap of claim 6, wherein the outwardly extending member is shaped to enclose a portion of the dispensing pump.

8. The housing cap of claim 6, wherein the outwardly extending member is shaped to be enclosed by a portion of the dispensing pump.

9. A dispenser assembly comprising:

a reservoir having an opening for fluid communication, the reservoir opening formed to receive a housing cap and a dispensing pump;

the housing cap having an outer surface in contact with the reservoir opening and an inner surface to engage the pump, the outer surface defining a lip for engaging to the reservoir opening and a step to engage a portion of the pump, the inner surface having a plurality of steps to engage the pump, the pump having a body and a dispenser portion, the body being engaged by the plurality of steps.

10. The dispenser assembly of claim 9, wherein the plurality of steps define a recess therebetween.

11. The dispenser assembly of claim 9, wherein the pump body further comprises a flange adapted to seat one of the plurality of steps.

12. The dispenser assembly of claim 9, further comprising a seal.

13. The dispenser assembly of claim 12, wherein the seal is disposed between the housing cap and the reservoir opening.

14. The combination of a dispenser mounted on a bottle comprising:

a. a bottle having:

i. a body;

ii. a neck atop the body forming an inlet passage terminating in an opening;

iii. thin walls being formed around the opening; and iv. a relatively thick section spaced some distance below the opening forming an undercut; and b. a dispenser having:

i. a housing having an open outer end; and ii. a plug inserted and retained in and projecting from the outer open end of said housing, c. said housing inserted in and engaging the inside of the neck below the undercut, with the projecting portion of the plug engaging outer portion of the inside of the neck.

15. The combination according to claim 14 wherein said plug further comprises a housing cap with an upper tapered cylindrical area engaging an outer portion of the bottle opening and a lower part engaging the inside of the housing in the area where the housing is engaging the inside of the neck.

16. The combination according to claim 15 wherein lower part engaging the inside of the housing has a thickened bead-like cross-section engaging a recess in the inner surface of the housing.

17. The combination according to claim 15 wherein said plug terminates in an annular flange with a flat inner surface which engages a flat surface at the top of said opening.

18. The combination according to claim 15 wherein said dispenser is a pump comprising:

a. a pump body having an inner end and an open outer end, and forming a cylinder;

b. a piston disposed for reciprocal movement in the cylinder;

c. a spring biasing the piston toward open outer end;

d. an inlet valve at the inner end of said cylinder, e. a stem having a central bore for dispensing a fluid from said cylinder;

f. an outlet valve coupling the cylinder to the bore of the stem;

g. an actuator disposed on said stem an in fluid communication therewith; and h. a plug inserted and retained in and projecting from the outer open end of said pump body, said plug restraining outward movement of the piston.

* * * * *